US008568343B2

(12) United States Patent
Fuster

(10) Patent No.: US 8,568,343 B2
(45) Date of Patent: Oct. 29, 2013

(54) APPARATUS FOR MOBILIZATION OF THE BODY, AND USE OF SUCH AN APPARATUS

(75) Inventor: Arnaud Fuster, Beaumont les Valence (FR)

(73) Assignee: LPG Finance Industrie, Valence (FR)

( * ) Notice: Subject to any disclaimer, the term of this patent is extended or adjusted under 35 U.S.C. 154(b) by 218 days.

(21) Appl. No.: 13/122,266

(22) PCT Filed: Oct. 16, 2009

(86) PCT No.: PCT/FR2009/051978

§ 371 (c)(1), (2), (4) Date: Apr. 1, 2011

(87) PCT Pub. No.: WO2010/049622

PCT Pub. Date: May 6, 2010

(65) Prior Publication Data

US 2011/0196270 A1 Aug. 11, 2011

(30) Foreign Application Priority Data

Oct. 27, 2008 (FR) ..... 08 57263

(51) Int. Cl.
*A61H 1/00* (2006.01)
*A61H 7/00* (2006.01)

(52) U.S. Cl.
USPC ..... 601/84; 601/85; 601/86; 601/87; 601/89; 601/90; 601/31; 74/490.09

(58) Field of Classification Search
USPC ..... 601/5, 23, 24, 26, 28–35, 49–51, 53, 601/54, 78, 83, 84, 85–87, 89, 90, 91–93, 601/97, 98, 100, 101, 104, 112; 482/70, 71, 482/79, 80, 1, 8, 9, 900–902; 366/111, 366/209–211, 215, 218; 74/16, 20, 490.08, 74/490.09, 490.1
See application file for complete search history.

(56) References Cited

U.S. PATENT DOCUMENTS 1,602,196 A * 10/1926 Iverson et al. ..... 601/92
2,047,316 A * 7/1936 Erickson ..... 601/16

(Continued)

FOREIGN PATENT DOCUMENTS

EP 1023111 A1 8/2000
GB 2094627 A 9/1982

(Continued)

OTHER PUBLICATIONS

European Patent Office, International Application No. PCT/FR2009/051978, International Search Report, dated Feb. 26, 2010 (2 pages).

*Primary Examiner* — Justine R Yu
*Assistant Examiner* — Michael Tsai
(74) *Attorney, Agent, or Firm* — Heslin Rothenberg Farley & Mesiti P.C.

(57) ABSTRACT

This apparatus for mobilization of the body comprises a receiving platform which is movable in relation to a fixed chassis, and which is designed to support a subject who is to be treated in a standing position. The platform is connected to the chassis by a double pivot connection, and it is driven by an oscillating movement in relation to an axis passing substantially through its center, by means of actuators each connected by a pivot connection to a shaft connected to said platform, said actuators themselves being articulated on the chassis.

12 Claims, 6 Drawing Sheets

(56) References Cited

U.S. PATENT DOCUMENTS

| | | | | | |
|---|---|---|---|---|---|
| 2,311,542 | A | * | 2/1943 | Holme | 5/609 |
| 2,827,894 | A | | 3/1958 | Meyers | |
| 2,945,492 | A | * | 7/1960 | Harvey | 601/86 |
| 3,326,209 | A | * | 6/1967 | Mandl | 601/86 |
| 3,403,905 | A | * | 10/1968 | Hamilton | 601/23 |
| 4,061,137 | A | * | 12/1977 | Sandt | 601/86 |
| 4,290,601 | A | | 9/1981 | Mittelstadt | |
| 4,306,714 | A | * | 12/1981 | Loomis et al. | 482/79 |
| 4,584,896 | A | * | 4/1986 | Letovsky | 74/490.1 |
| 4,946,160 | A | * | 8/1990 | Bertoletti | 482/71 |
| 5,242,356 | A | * | 9/1993 | Grenfell | 482/142 |
| 5,728,049 | A | * | 3/1998 | Alberts | 601/24 |
| 6,063,046 | A | | 5/2000 | Allum | |
| 6,464,652 | B1 | * | 10/2002 | Hubbard et al. | 601/5 |
| 7,390,287 | B2 | * | 6/2008 | Wu | 482/51 |
| 7,530,959 | B2 | * | 5/2009 | Matano' et al. | 601/23 |
| 2002/0115536 | A1 | * | 8/2002 | Hojo et al. | 482/51 |
| 2007/0123401 | A1 | * | 5/2007 | Ozawa et al. | 482/148 |
| 2009/0143197 | A1 | * | 6/2009 | Chen et al. | 482/1 |

FOREIGN PATENT DOCUMENTS

| | | | |
|---|---|---|---|
| WO | WO-03088887 | A2 | 10/2003 |
| WO | WO-2007141429 | A1 | 12/2007 |

* cited by examiner

APPARATUS FOR MOBILIZATION OF THE BODY, AND USE OF SUCH AN APPARATUS

CROSS REFERENCE TO RELATED APPLICATION

This application is a National Stage application under 35 U.S.C. §371 of PCT Application No. PCT/FR2009/051978, filed Oct. 16, 2009, which claims priority to French Application No. FR 0857263, filed Oct. 27, 2008, entitled "Apparatus For Mobilization of The Body, and Use of Such an Apparatus."

FIELD OF THE INVENTION

The invention relates to an apparatus that is designed to mobilize the body of a subject, and to be more specific is capable of mobilizing the vertebral axis, the pelvic joint and the lower limbs in relation to said vertebral axis.

The invention thus forms part of research into said mobilization of the body by implementing a platform or tray capable of oscillating in accordance with an infinite number of axes passing through its centre, these different oscillations being capable of being implemented randomly.

DESCRIPTION OF THE PRIOR ART

Various pieces of apparatus capable of performing operations to correct and rehabilitate general biomechanics have been proposed hitherto. These were originally designed for training purposes, and particularly for muscle training for sportsmen.

Said apparatus generally comprises a platform capable of oscillating in relation to a central support pivot, as described for example in documents U.S. Pat. No. 2,827,894 or U.S. Pat. No. 4,290,601. The movement of the platform induces an imbalance of the subject standing thereon, suitable for inducing reactions on the part of the subject and mobilizing as required the various biomechanical elements, and particularly the spinal column, the pelvic girdle and the joints.

Document EP 1 023 111 also discloses an apparatus in which the platform is driven in both a rotary movement and an oscillating movement. In other words, the kinetics of the apparatus described in this document is limited to a rotary oscillation, adjustable in amplitude and speed. However, said apparatus proves particularly complex to implement and moreover, the oscillating movements are limited in terms of amplitude by the structures themselves as implemented, and randomness of oscillation is not obtainable for the same reasons.

Document WO 2007/141429 proposes another apparatus of the type in question, but which, here too, has limited degrees of freedom in terms of oscillation, because of the mode of support and motorization of the platform with which it is provided, thereby reducing the possibilities and effectiveness of the treatment, due to the lack of any randomness in the oscillations.

The invention relates to an apparatus of the type in question which can be used to confer on the platform a multitude of degrees of freedom in terms of oscillation, and which is in other words capable of conferring on a platform an infinite number of possible tilts in relation to an axis passing substantially through its centre. There ensues from this infinite number the possibility of implementing discrete tilts and therefore of conferring randomness on the oscillation, suitable in particular for promoting rehabilitation, or even training as regards sportsmen.

SUMMARY OF THE INVENTION

The invention thus relates to an apparatus for mobilization of the body comprising a receiving platform which is movable in relation to a fixed chassis, and which is designed to support a subject who is to be treated in a standing position.

According to the invention, the platform is connected to the chassis by a double pivot connection and it is driven in an oscillating movement, in relation to an axis passing substantially through its centre, by means of actuators which are each connected by a pivot connection to a single shaft connected to said platform, said actuators themselves being articulated on the chassis.

To be more specific, the platform is articulated on an upper frame defining a first substantially horizontal axis of articulation, said upper frame itself being articulated on the chassis along a second substantially horizontal axis of articulation perpendicular to said first axis.

Said platform is provided with a central axis or arm, extending perpendicularly in relation to the plane it defines, and the actuators, which are two in number, are connected to the free end of said shaft by means of a cardan coupling, said actuators having a substantially perpendicular direction of actuation one in relation to the other.

These actuators are each constituted by a linear actuator, and particularly an electric linear actuator, the point where it is fixed to the chassis being constituted by a pivot connection.

To advantage, the apparatus of the invention for mobilization of the body is associated with handles and in general terms with any holding means, so that the subject who is to be treated or trained is able to keep steady by means of his upper limbs, in consideration of the imbalances to which he is subjected, given the oscillation of the platform on which he is standing.

The invention also relates to the use of the apparatus of the invention for mobilization of the body, according to which the amplitude and the different oscillating movements imparted to the platform are adjusted according to pre-set programs, capable of including a random oscillation mode.

Alternatively, the oscillating movements of the platform are imparted in real time at the command of a "joystick" that can be handled by a person controlling said mobilization of the body, and in particular by a practitioner. Should this be the case, the response of the platform is immediate and direct, and faithfully follows the action of the practitioner by means of the orders given through the joystick.

BRIEF DESCRIPTION OF THE DRAWINGS

The way in which the invention can be implemented, and the resulting advantages, will become clearer from the following embodiment example, which is given for information purposes and non-restrictively, supported by the appended figures.

DETAILED DESCRIPTION OF THE INVENTION

Figure 1:
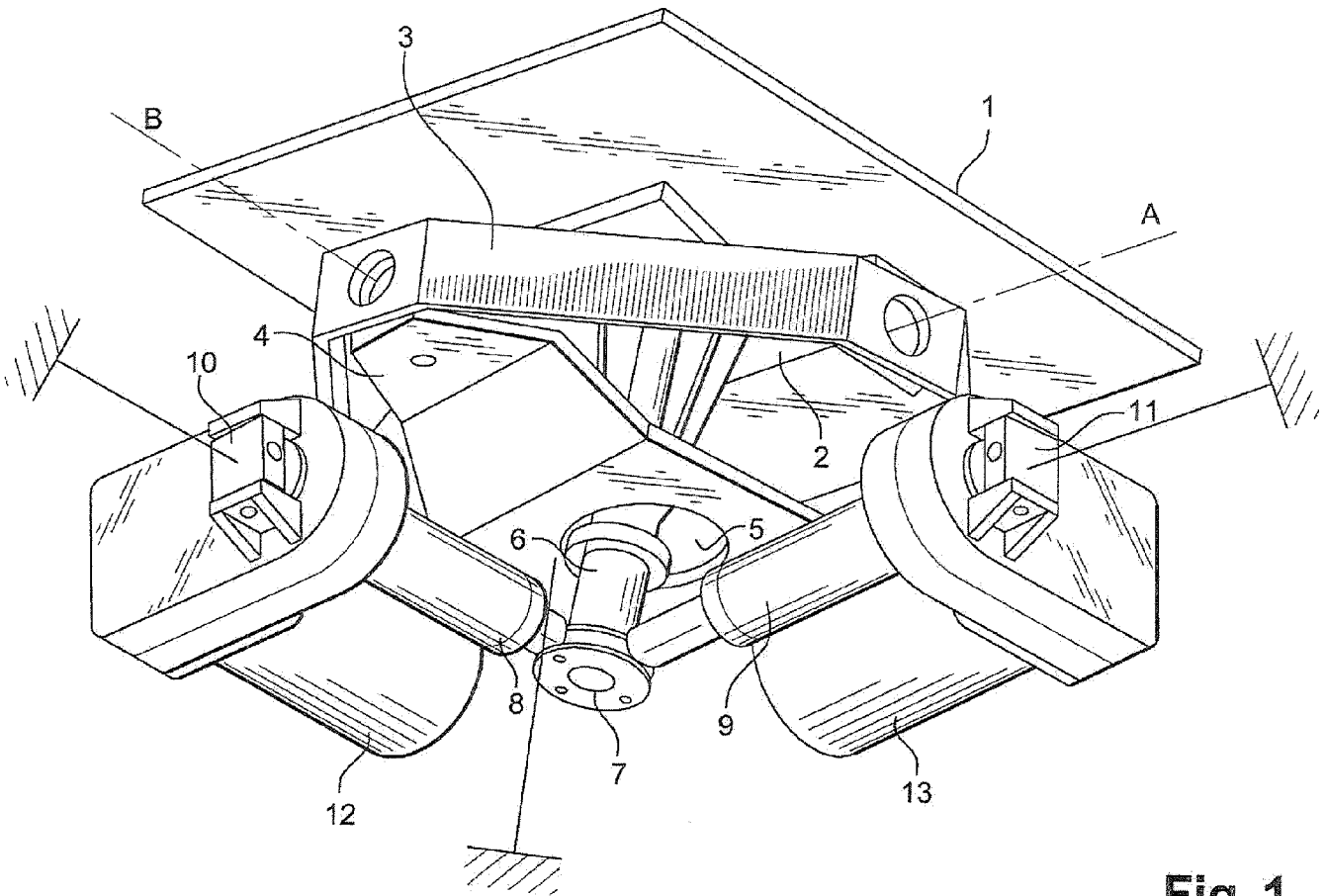
FIGS. 1 and 2 are two perspective diagrammatic representations viewed along two different orientations of the operating principle of the apparatus for mobilization of the body according to the invention.
Figure 2:
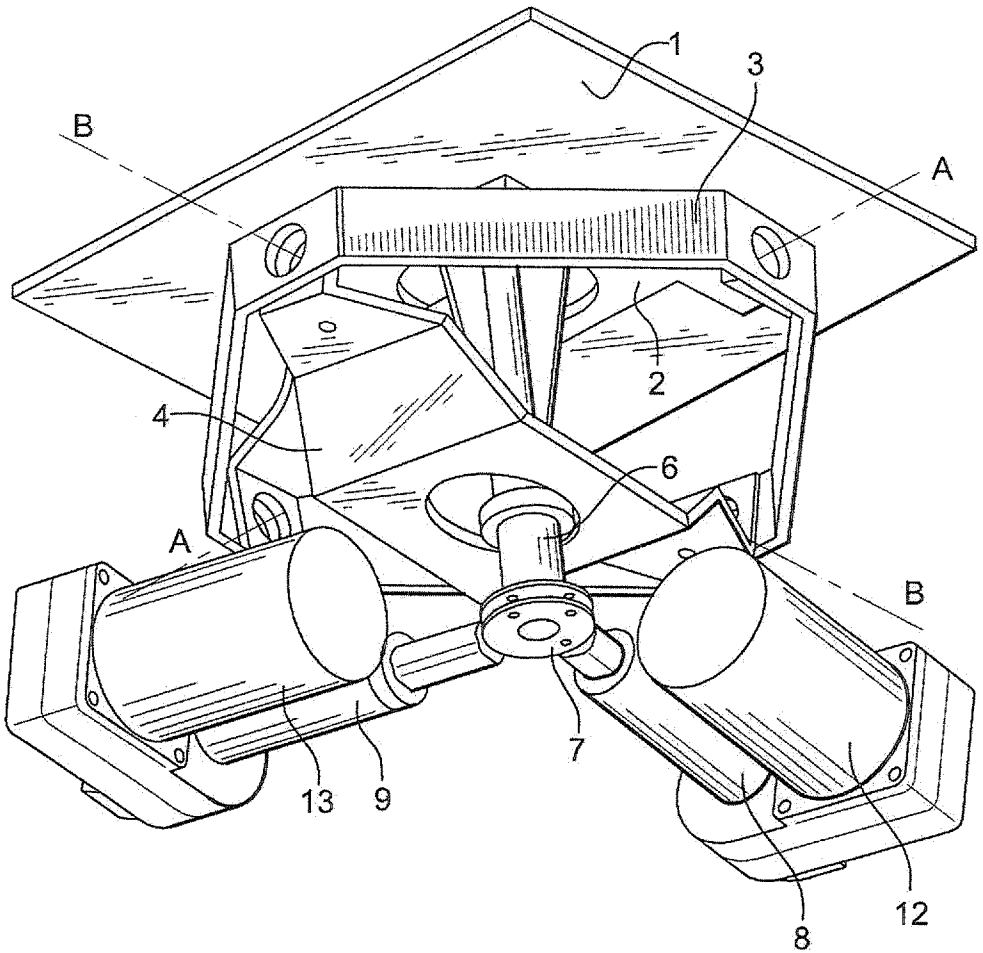
Figure 3:
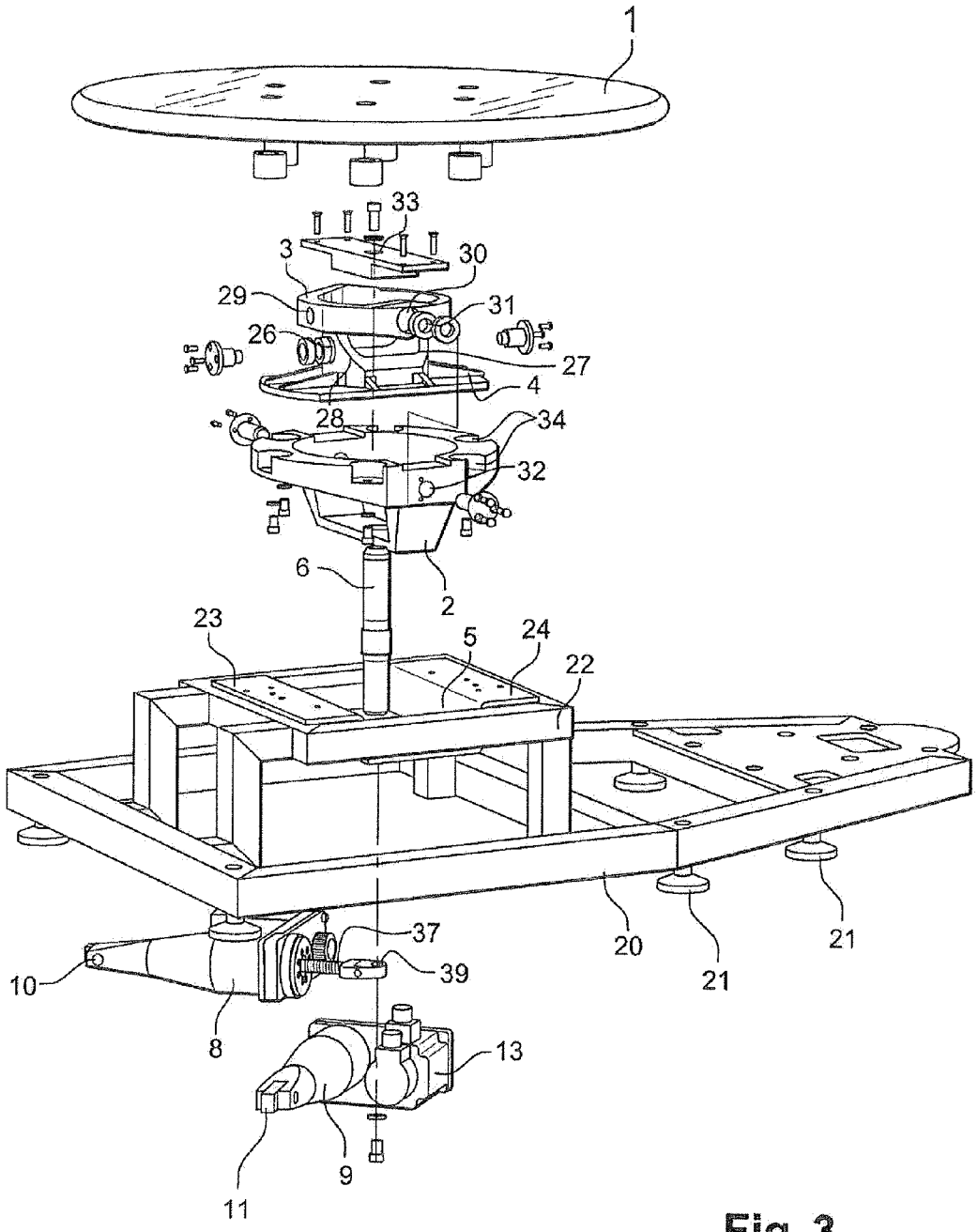
FIG. 3 is an exploded perspective diagrammatic representation of one embodiment of the invention.
Figure 4:
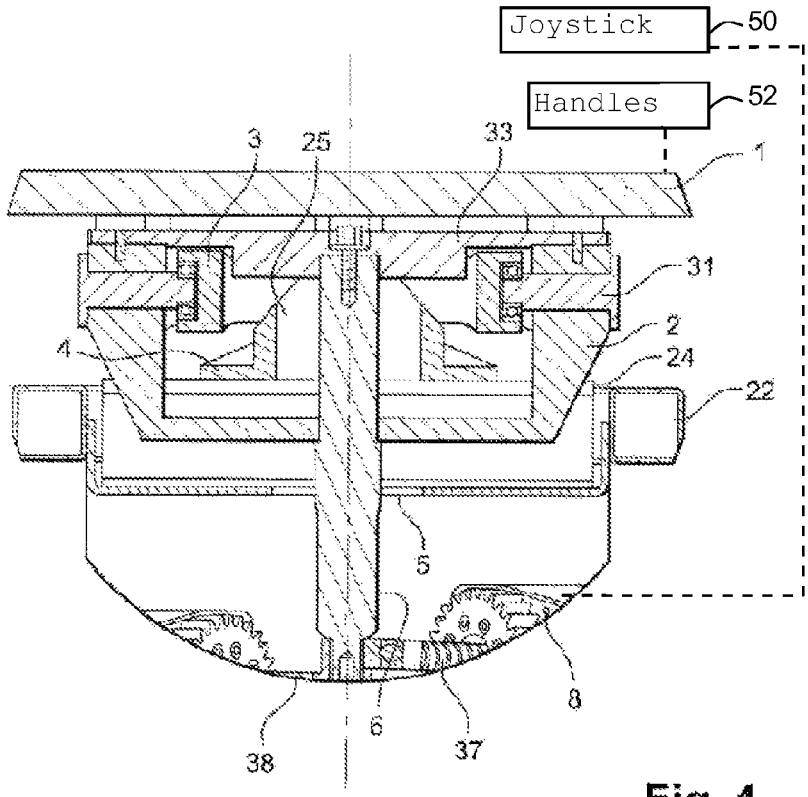
FIGS. 4 and 5 are two diagrammatic views in sagittal cross-section of the apparatus of the invention, along two planes perpendicular one in relation to the other.
Figure 5:
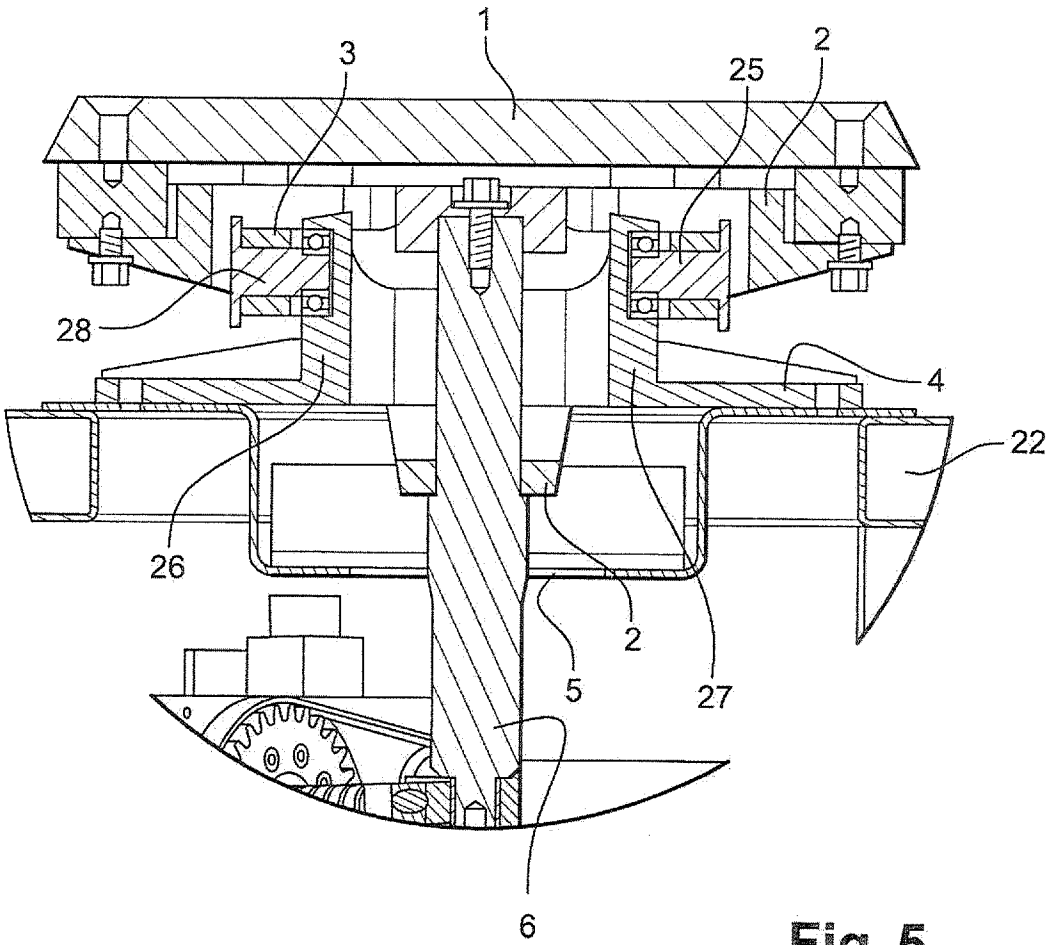

A perspective view is shown diagrammatically in FIGS. 1 and 2, suitable for illustrating the operating principle of the apparatus of the invention.

Basically, it comprises a platform 1, diagrammatically shown as square in shape, but which could take any other shape, and in particular circular or oval.

This platform 1 is articulated by means of a rigid armature 2 on an upper rigid frame 3, along a horizontal axis of articulation A-A shown as dotted lines in said FIG. 1. In other words, the connection of the platform 1 on this upper frame 3 is a pivot connection, said platform 1 therefore being capable of pivoting in relation to the aforementioned axis A-A.

Consequently, the upper frame 3 is itself articulated on a rigid armature 4 integral with the chassis of the apparatus, along an axis of articulation B-B shown as dotted lines, also horizontal, and orientated perpendicularly in relation to the axis A-A.

In other words, the platform 1 is connected to the chassis via a double pivot connection.

Given this double pivot connection, the platform 1 is therefore capable of presenting an infinite number of orientations in relation to its original horizontal plane.

To actually allow this multiplicity of orientations, and therefore consequently to impart to the subject taking up a position on said platform an infinite number of oscillating movements for the purpose of varying his balance and bringing about the different required mobilizing movements, said platform 1 is extended in the downward direction by a shaft 6, substantially connected to the centre of the platform, by any means, and for example by screws or the equivalent. Thus and in the example described, the shaft 6 is orientated perpendicularly in relation to the plane defined by the platform 1.

The free end of this shaft 6, in other words the end opposite the platform 1, is connected by pivot connection to two actuators 8 and 9, constituted in the case in point by electric linear actuators.

Said actuators are themselves connected to the chassis of the apparatus by means of pivot connections 10 and 11 respectively, and in the case in point cardan couplings, conferring on said actuators a certain travel in the horizontal plane.

To be more specific, these actuators 8 and 9 are each constituted by a ball screw capable of turning in both directions by means of a brushless motor, 12 and 13 respectively, provided with an encoder or even a reducer if need be. The free end of each of the screws is connected to the free lower end 7 of the shaft 6 by means of a cardan coupling, in order, here too, to provide for an angular displacement of the end of the screw in relation to the free end 7 of the shaft 6. The two actuators 8 and 9 are orientated perpendicularly one in relation to the other, when the platform 1 is in the rest position, in other words plane or horizontal.

That being the case it can be conceived that by playing on the one hand on the respective speeds of rotation of the brushless motors 12, 13, and on the other hand, on the direction of rotation of the screws, it is possible to confer on the shaft 6 and consequently on the platform 1 which is directly connected thereto, all possible types of orientations. The travel of the shaft 6 is however limited by construction, and in the case in point by an aperture 5 provided in the rigid armature 4.

The objective sought is not to confer too much inclination on the platform, but to confer thereon an unlimited and indeterminate number of orientations, and therefore to multiply the number of possible oscillations in relation to its central axis 6.

A particular embodiment of the apparatus of the invention is shown in relation to FIGS. 3 to 6. Thus, this apparatus is constituted by a mount 20, standing on the ground by means of feet 21, of which there are six in the case in point, provided to advantage with a non-slip coating.

This mount 20 receives an upper chassis 22, which is directly connected thereto, for example by welding.

This upper chassis 22 is provided with two plates 23, 24 for fixing the rigid armature 4. These two fixing plates are separated from each other, and define, in cooperation with the upper chassis 22, the aperture 5 for delimiting the extent of the travel of the shaft 6.

The rigid armature 4 is provided at its centre with a through opening 25, intended to allow the shaft 6 to pass through. It is fixed by means of screws onto said plates 23, 24. It is further provided with opposite vertical extensions 26, 27, whereof the external faces each receive an articulation cotter pin 28, suitable for engaging with through orifices 29, provided on the periphery of the upper frame 3.

Said upper frame 3 is also cut out at its centre, still with the objective of allowing the shaft 6 to pass through. Furthermore, it comprises two other through orifices 30, also opposite one another, but whereof the axis which connects them, and corresponding to the axis A-A in FIGS. 1 and 2, is oriented at 90° from the axis connecting the through orifices 29, and corresponding to the axis B-B in said FIGS. 1 and 2.

These through orifices 30 each receive in their turn an articulation cotter pin 31, suitable for engaging with through orifices 32 provided on the periphery of the rigid armature 2. The latter is provided with an upper surface, onto which is screwed a plate 33 integral with the tray constituting the platform 1, a plate to which is connected, also by screwing, the upper end of the shaft 6.

The tray for its part is bolted onto the upper face of the rigid armature 2, the latter being provided with housings 34 intended to receive the bolts or nuts.

Figure 6:
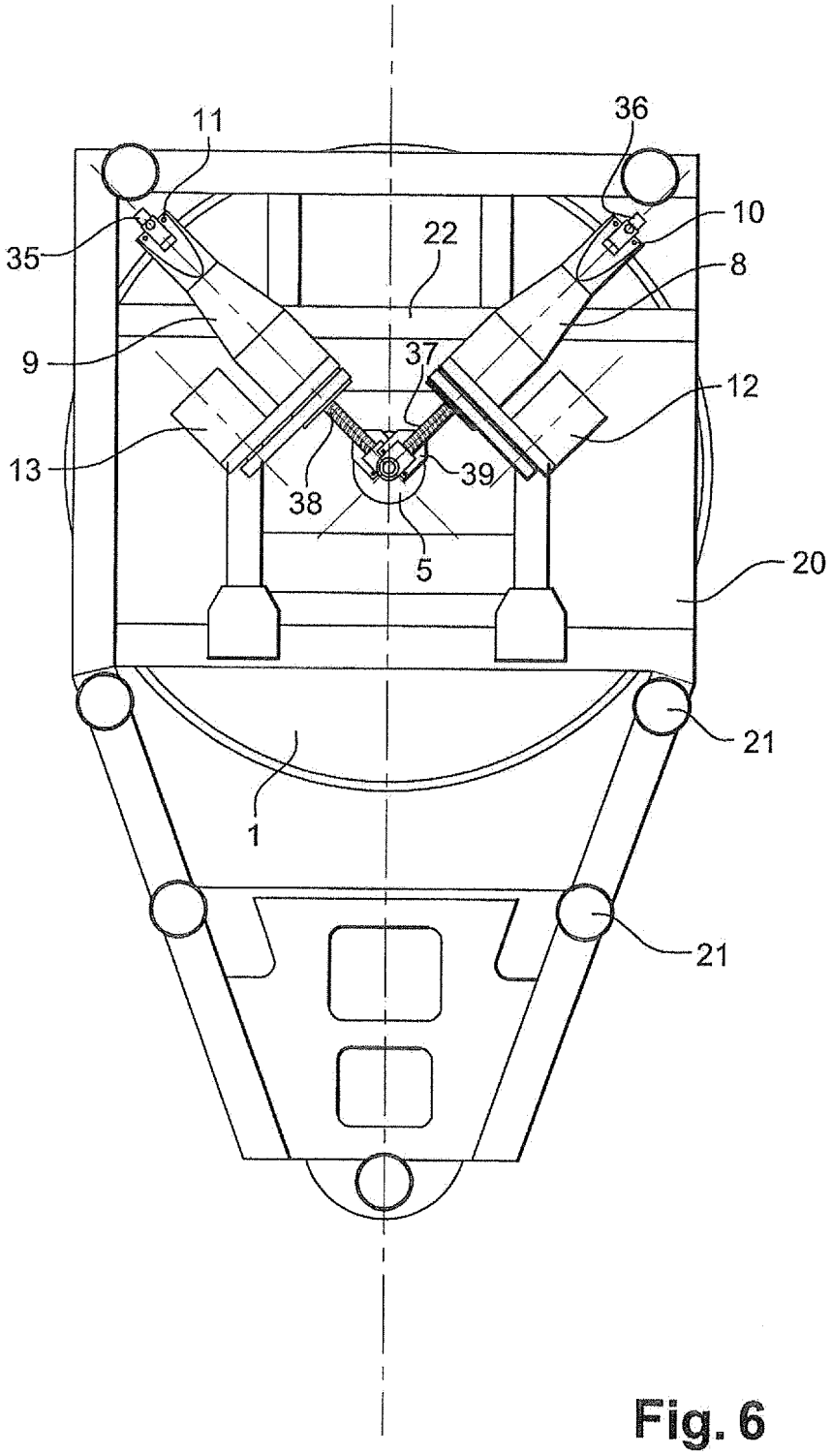
FIG. 6 is a diagrammatic representation of the apparatus of the invention seen from underneath.

The location of the actuators 8 and 9 has been shown in FIG. 6. They are situated sub-jacently in relation to the apparatus unit, and are housed in the volume defined by the mount 20, and under the upper chassis 22. Said actuators are connected respectively to a corner of the mount 20, by means of a pivot connection 10, 11, whereof the axis passes through an attach tab 35, 36 integral with the mount.

The end of the ball screws 37, 38 constituting these actuators is fixed to the lower end of the shaft 6 by means of a cardan coupling 39,40.

It may be seen that given the infinite number of possible tilting movements of the platform, the end result may be a significant mobilization of the vertebral axis. By doing this, the apparatus of the invention is most specifically appropriate to pathologies frequently encountered in relation to said vertebral axis.

Furthermore, this apparatus is capable of being employed in respect of other uses, among which may be cited, without this being in any way restrictive:

- re-shaping;
- body balance;
- slimming;
- rehabilitation, and in particular of the shoulder, knee, hip, spinal column;
- training for sportsmen and -women, and in particular at a high level.

Depending on the pathologies detected or on the uses envisaged, different oscillation speed and oscillation angle programs can be implemented by means of a programmable logic controller, acting directly on the brushless motors of the two actuators.

Consequently, it is also conceivable to confer specific movements on the platform, for example by means of a "joystick", directly actuated by a practitioner who is monitoring the subject, the movements of the "joystick" corresponding to the movements conferred on the platform. It is thus possible to adapt the care in a very precise way, as a function of the pathology detected. It is furthermore conceivable to program a specific trajectory linked to the pathology of the subject, and to implement it automatically in self-service mode.

The apparatus is further provided with handles (not shown) situated substantially at trunk height for a normal user so that he may stand firm and not be at risk of falling over, given the oscillating movements conferred on the platform on which he is set in a standing position. These handles may further be driven in particular movements, suitable for optimizing the requisite rehabilitation or body-building activity.

The invention claimed is:

1. An apparatus for mobilization of the body comprising a platform which is movable in relation to a chassis and which is designed to support a subject who is to be treated in a standing position, wherein the platform is connected to the chassis by a double pivot connection, and wherein the platform is driven in an oscillating movement in relation to an axis passing substantially through a centre of said platform, by means of actuators which are each connected by respective pivot connections to a single shaft connected to said platform, said actuators themselves being articulated on the chassis;

wherein the platform is articulated on a rigid upper frame or armature, defining a first substantially horizontal axis of articulation, said upper frame itself being articulated on a rigid armature along a second substantially horizontal axis of articulation perpendicular to said first axis of articulation, said rigid armature being integral with the chassis; and wherein the platform is provided with a central axis or arm, extending perpendicularly in relation to the plane that it defines, and in that the actuators which are two in number, are connected to a free end of said shaft by means of a cardan coupling, said actuators having a substantially perpendicular direction in relation to one another.

2. The apparatus for mobilization of the body as claimed in claim 1, wherein the actuators are each constituted by a linear actuator, a point where it is fixed to the chassis being constituted by a pivot connection.

3. The apparatus for mobilization of the body as claimed in claim 2, wherein the actuators are each constituted by a ball screw capable of turning in both directions by means of a brushless motor, provided with an encoder.

4. The apparatus for mobilization of the body as claimed in claim 3, wherein an amplitude and different oscillating movements imparted to the platform are adjusted according to pre-set programs, capable of including a random oscillation mode.

5. The apparatus for mobilization of the body as claimed in claim 3, wherein an amplitude and different oscillating movements are imparted to the platform in real time on command from a joystick that may be handled by a person controlling said mobilization of the body, and in particular by a practitioner.

6. The apparatus for mobilization of the body as claimed in claim 2, wherein an amplitude and different oscillating movements imparted to the platform are adjusted according to pre-set programs, capable of including a random oscillation mode.

7. The apparatus for mobilization of the body as claimed in claim 2, wherein an amplitude and different oscillating movements are imparted to the platform in real time on command from a joystick that may be handled by a person controlling said mobilization of the body, and in particular by a practitioner.

8. The apparatus for mobilization of the body as claimed in claim 1, wherein it further comprises holding apparatus that allow the subject who is to be treated or trained to keep steady by means of his upper limbs, in consideration of the imbalances to which he is subjected, given the oscillation of the platform on which he is standing.

9. The apparatus for mobilization of the body as claimed in claim 8, wherein an amplitude and different oscillating movements imparted to the platform are adjusted according to pre-set programs, capable of including a random oscillation mode.

10. The apparatus for mobilization of the body as claimed in claim 8, wherein an amplitude and different oscillating movements are imparted to the platform in real time on command from a joystick that may be handled by a person controlling said mobilization of the body, and in particular by a practitioner.

11. The apparatus for mobilization of the body as claimed in claim 1, wherein an amplitude and different oscillating movements imparted to the platform are adjusted according to pre-set programs, capable of including a random oscillation mode.

12. The apparatus for mobilization of the body as claimed in claim 1, wherein an amplitude and different oscillating movements are imparted to the platform in real time on command from a joystick that may be handled by a person controlling said mobilization of the body, and in particular by a practitioner.

* * * * *